United States Patent [19]

Henson

[11] 4,126,997

[45] Nov. 28, 1978

[54] METHOD FOR LUBRICATING TURBOCHARGED ENGINES

[75] Inventor: Ralph B. Henson, Creve Coeur, Ill.

[73] Assignee: Caterpillar Tractor Co., Peoria, Ill.

[21] Appl. No.: 815,746

[22] Filed: Jul. 14, 1977

Related U.S. Application Data

[62] Division of Ser. No. 693,235, Jun. 4, 1976, Pat. No. 4,058,981.

[51] Int. Cl.[2] ..... F02B 33/40

[52] U.S. Cl. ..... 60/605; 184/6.3

[58] Field of Search ..... 60/605, 39.08; 123/196 R, 196 S; 184/6.21, 6.3

[56] References Cited

U.S. PATENT DOCUMENTS

| | | | |
|---|---|---|---|
| 3,045,420 | 7/1962 | Addie et al. | 60/605 |
| 3,057,436 | 10/1962 | Jacobson et al. | 184/6.3 |
| 3,138,221 | 6/1964 | Kofink et al. | 123/196 S |
| 3,203,514 | 8/1965 | Davies et al. | 60/39.08 |

*Primary Examiner*—Carlton R. Croyle
*Assistant Examiner*—Michael Koczo, Jr.
*Attorney, Agent, or Firm*—Phillips, Moore, Weissenberger, Lempio & Majestic

[57] ABSTRACT

An engine comprises a pump adapted to communicate lubricating oil from the crank case thereof to a directional control valve. Upon engine start-up, the valve is conditioned to communicate oil through a filter and to a first manifold which, in turn, communicates with the crankshaft and rod bearings of the engine. Simultaneously therewith, cooled but unfiltered oil is communicated directly to bearings rotatably mounting a shaft in a turbocharger, mounted on the engine. After start-up, the valve will shift to further communicate unfiltered oil directly to a second manifold which, in turn, communicates with a plurality of jets for the purpose of cooling the pistons employed in the engine. The shifted valve will further function to permit communication of oil through the filter to the bearings of the turbocharger and to the crankshaft and rod bearings of the engine.

6 Claims, 4 Drawing Figures

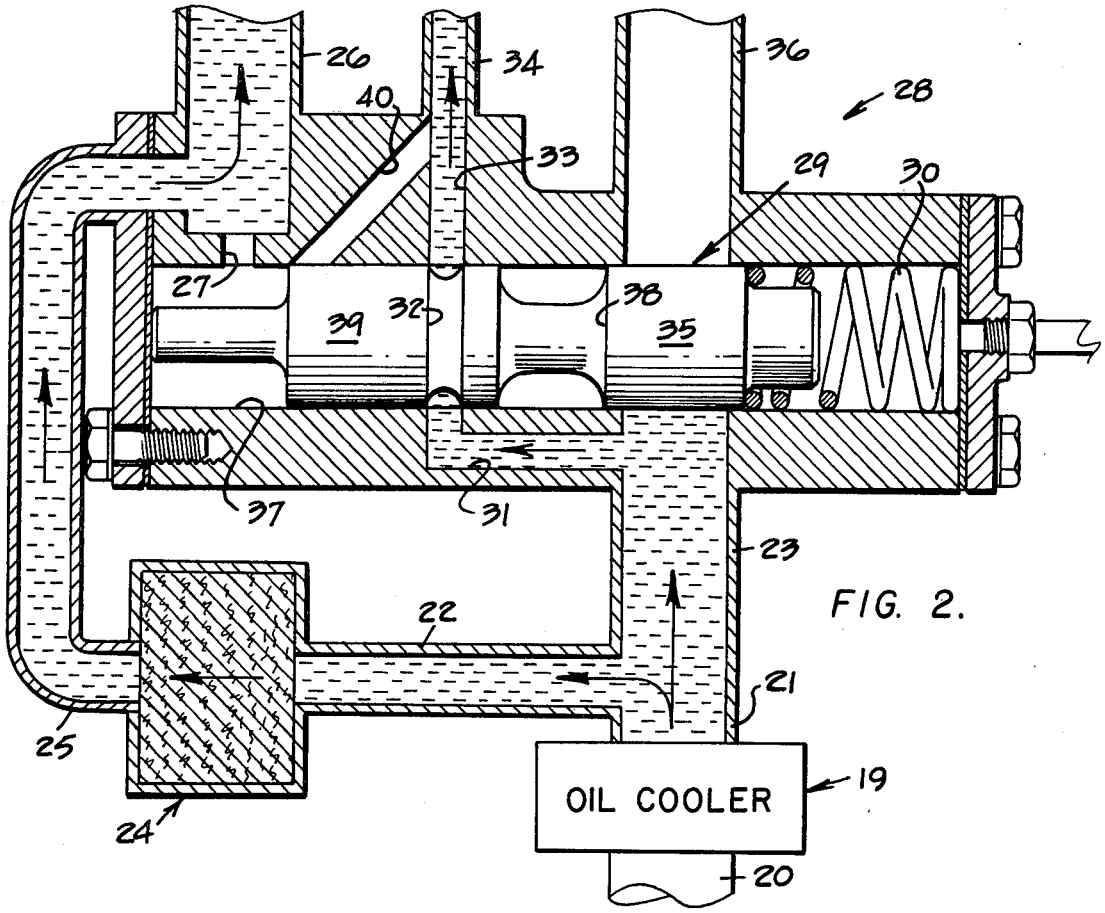
FIG. 2.
FIG. 1.
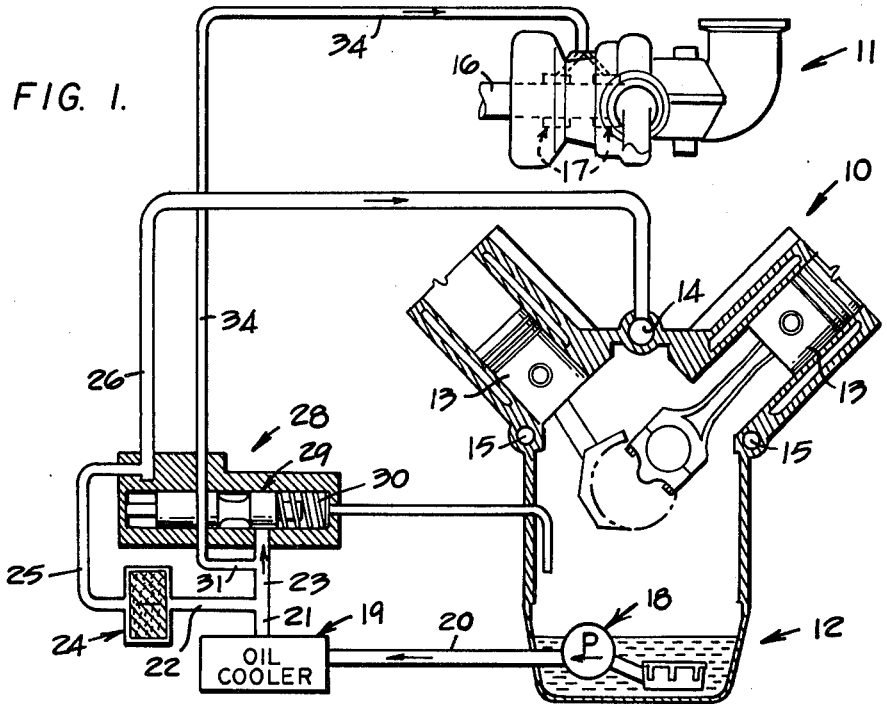

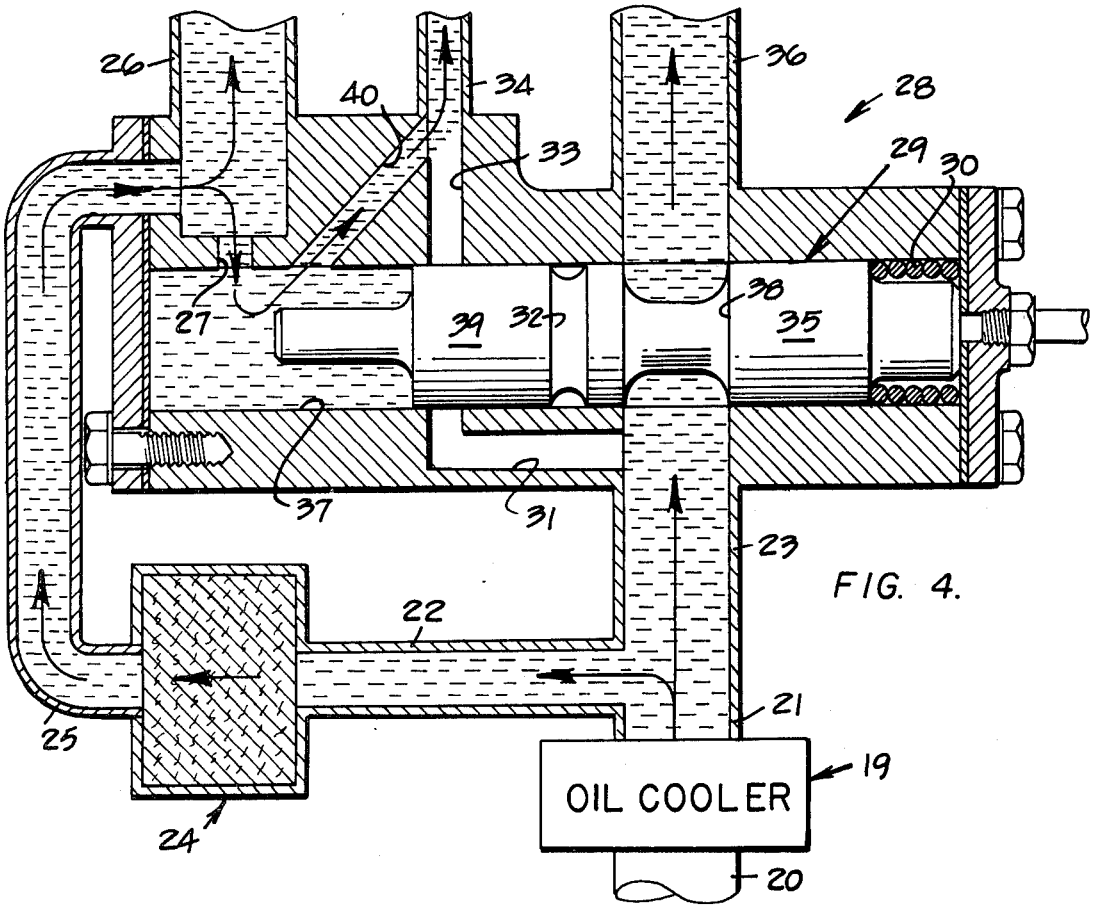
FIG. 4.
FIG. 3.
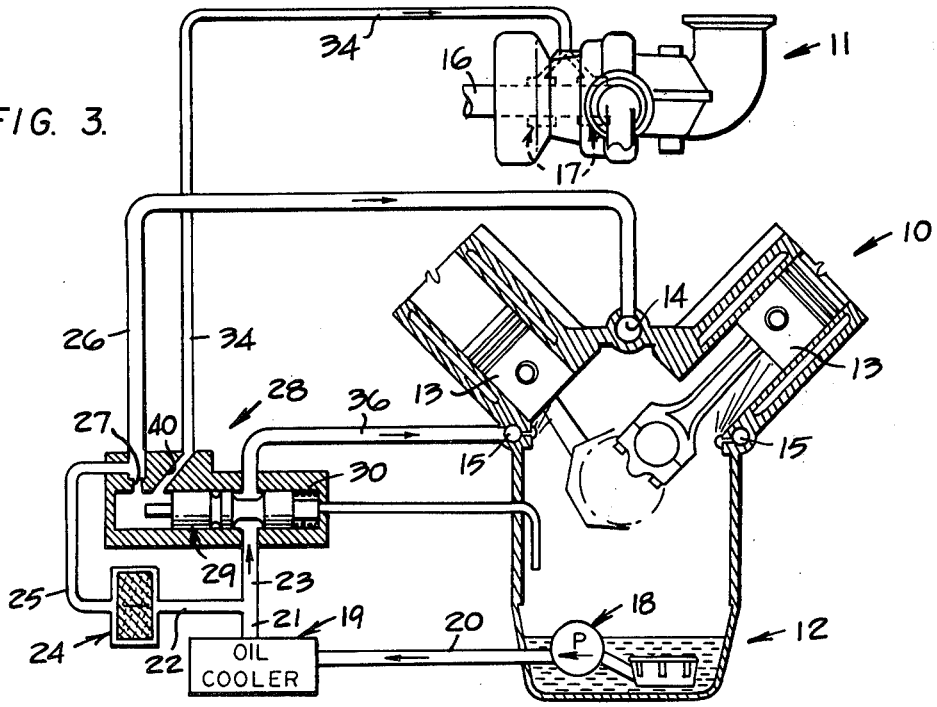

METHOD FOR LUBRICATING TURBOCHARGED ENGINES

This is a division of Ser. No. 693,235, filed June 4, 1976, and now U.S. Pat. No. 4,058,981.

BACKGROUND OF THE INVENTION

This invention relates to a method for supplying lubricating and cooling oil to the crankshaft and rod bearings of an engine, to the bearings of a turbocharger mounted on the engine and to cooling jets associated with pistons reciprocally mounted in the engine.

Upon the start-up of an internal combustion engine, lubricating oil must be communicated to the crankshaft and rod bearings thereof immediately. In addition, it is common practice to employ a turbocharger in association with the engine, which has a common shaft attached between the turbine and compressor wheels thereof. The shaft is mounted for hi-speed rotation in annular bearing assemblies which also require immediate lubrication to prevent undue wear or damage thereto.

The time required to communicate lubricant to such bearings primarily depends upon the resistance which the oil meets an its communication through the various oil passages and bearing clearances while the oil pump is functioning to fill the system and build-up the required working pressures. During cold starts of the engine, such pressure build-up may take as long as 15 to 30 seconds. In many cases, such a time delay is sufficient to starve the bearings of lubricant and to thus cause damage to such bearings and attendant components of the engine.

A further problem may be encountered due to the inherent operation of an oil filter by-pass valve which is designed to open when the oil filter becomes sufficiently clogged to effect a pressure drop thereacross, usually approximating from 12 to 15 psi. Such by-pass operation ensures that a clogged filter will not prevent oil from reaching the engine nor will it rupture or spill contaminates into the engine. When a large volume oil manifold is used downstream of the filter, as is common with engines having several cylinders with piston cooling jets, the oil pump will strive to force oil through the filter quickly to thus fill the volumes downstream of the oil filter. The cooling jets, meanwhile, tend to drain oil out of the manifold while the oil pump is attempting to fill it.

Frequently, depending on oil temperature which determines oil viscosity, the oil passing through the filter will build-up a sufficient pressure drop thereacross to activate the by-pass valve to thus circumvent oil around the filter. When such a condition occurs, the crankshaft and rod bearings will be subjected to contaminants, thus resulting in the wear and possible failure thereof.

Various prior art apparatus and methods have been proposed to overcome the above problems but cannot always be employed on all engines and are also, by nature, complex and costly to manufacture and install. Once such method utilizes a "pre-lube" pump which is driven by an auxiliary motor normally powered by a D.C. electrical source, such as a standard battery. Another method employs an auxiliary pump that runs continuously, being powered by an A.C. electrical course, so that the engine may be fired at any time.

Engines employing cooling jets thereon suffer from lubrication difficulties of another kind when they are running at low idle and the oil is hot. In particular, the oil pressure in the system will begin to drop with decreased engine speed, after the pump pressure by-pass valve closes. While idling, the pump must supply enough oil to satisfy the requirements of the piston cooling jets, which are not needed at idle, plus the requirements of all of the bearings employed in the engine. As bearings wear, their clearances increase to thus decrease oil pressure while increasing oil flow.

Such decrease in oil pressure will ultimately result in engine shut-down, on engines which employ a low oil pressure shut-off apparatus thereon, or eventual engine damage from oil starvation in engines which do not employ such an apparatus thereon. The most commonly used method for overcoming this problem is the use of a pump with a sufficiently large capacity to make the probability of oil starvation remote. The latter method is costly and results in excessive power consumption by the oversized pump which is not required during most phases of engine operation.

SUMMARY OF THIS INVENTION

An object of this invention is to provide an economical and non-complex and method for lubricating a turbocharged engine. The engine comprises a first manifold means for communicating lubricant to the crankshaft and rod bearings thereof and a second manifold means for communicating lubricant to jets, adapted to cool pistons reciprocally mounted in the engine. A turbocharger is mounted on the engine and has bearing means therein for rotatably mounting a shaft, having turbine and compressor wheels secured thereon.

The method comprises first communicating lubricant only to the crankshaft and rod bearings and the bearing means of the turbocharger upon start-up of the engine and thereafter communicating lubricant to the crankshaft and rod bearings, the bearing means of the turbocharger and to the cooling jets after start-up of the engine and when the pressure of the lubricant has exceeded a predetermined level.

BRIEF DESCRIPTION OF THE DRAWINGS

Other objects of this invention will become apparent from the following description and accompanying drawings wherein:

FIG. 1 schematically illustrates an internal combustion engine having a turbocharger associated therewith and a lubricating system for communicating lubricant to the engine and to the turbocharger upon engine start-up;

FIG. 2 is an enlarged, sectional view of a directional control valve employed in the lubricating system and shown at a first position thereof, during engine start-up;

FIG. 3 is a schematical view, similar to FIG. 1, but showing the lubricating system in an after start-up condition of engine operation; and FIG. 4 is a view similar to FIG. 2, but illustrating the directional control valve in a second position during the after start-up condition of engine operation.

DETAILED DESCRIPTION

FIG. 1 schematically illustrates an internal combustion engine 10 having a standard turbocharger 11 suitably associated therewith. The engine is of conventional design to comprise a crank case 12 adapted to retain lubricating oil therein and a plurality of pistons 13 reciprocally mounted in the engine. A first manifold means 14 is mounted on the engine to communicate lubricating oil to the crankshaft and rod bearings thereof in a conventional manner.

A second manifold means 15 is also mounted on the engine for communicating lubricating oil to the schematically illustrated cooling jets, mounted adjacent to the underside of pistons 13, also in a conventional manner. Turbocharger 11 comprises a shaft 16 common to compressor and turbine wheels secured thereon. The shaft is rotatably mounted in annular bearing means 17, adapted to have lubricating oil communicated thereto, as will be hereinafter described.

The lubricating system for communicating oil from crankcase 12 to manifold means 14 and 15 and to bearing means 17 is shown in its condition of operation when engine 12 is initially started-up. An engine driven pump means 18 is adapted to communicate oil through an oil cooler 19 via a conduit 20. An outlet conduit 21 from the oil cooler divides into branch conduits 22 and 23 for communicating lubricating oil to manifold means 14 and to bearing means 17, respectively.

As more clearly shown in FIG. 2, oil flowing into branch conduit 22 passes through a standard filter 24 (which may have a conventional by-pass valve, not shown, associated therewith) wherefrom the oil flows into a conduit 25. Conduit 25 communicates oil to a conduit 26 which, in turn, communicates the oil to manifold means 14 to lubricate the crankshaft and rod bearings of the engine. Simultaneously therewith, oil will flow through a port 27, formed in the housing of a directional control valve means 28, for purposes hereinafter fully explained.

Upon engine start-up, unfiltered lubricating oil from branch conduit 23 is communicated directly to bearing means 17 of turbocharger 11, through the directional control valve means. In particular, a spool 29 is reciprocally mounted in the directional control valve means and is initially spring-biased leftwardly by a compression coil spring 30 to communicate oil to bearing means 17 via an inlet or first passage 31, an annular groove 32 formed about spool 29, an outlet or second passage 33 and a conduit 34.

Thus, the full capacity of pump 18 may be utilized to assure that sufficient lubricating oil is communicated to the crankshaft and rod bearings of the engine and to bearing means 17 of turbocharger 11 to prevent undue wear or damage thereto. Simultaneously therewith, a land 35 of spool 29 will block communication of conduit 23 with a conduit 36, communicating with second manifold means 15 employed for piston cooling purposes. Thus, manifold means 14 may be designed with a smaller capacity than would be required should it be made common with manifold means 15. Manifold means 14 will thus quickly fill and the prospect of an excessive pressure drop across filter 24 is minimized.

Referring to FIGS. 3 and 4 which illustrate the lubricating system in an after start-up condition of engine operation, spool 29 will move automatically rightwardly against the counter-acting force of spring 30 when the pressure build-up in the system exceeds a predetermined level. For example, when the oil pressure communicated to an expansible chamber 37 via port 27 exceeds 10.5 psi, the spool will initiate its rightward movement from its FIG. 2 closed first position towards its FIG. 4 open position. Upon cracking of the spool, a second annular groove 38, formed about the spool, will begin to supply pressurized oil to conduit 36 which, in turn, communicates such oil to the piston cooling jets. At 20 psi, for example, the spool will move fully rightwardly to its FIG. 4 position whereby annular groove 38 is fully open to freely communicate pressurized oil to conduit 36.

As further shown in FIG. 4, annular groove 32 is now closed by its movement out of communication with passage 31 and a second land 39 of the spool blocks communication between passages 31 and 33. A branch or third passage 40 will take over to communicate filtered lubricating oil from chamber 37 to conduit 34 to lubricate bearing means 17 of the turbocharger.

When the "hot" engine is brought down to a low idle condition of operation, system pressures will also lower automatically. Thus, valve spool 29 will move from its FIG. 4 position towards its FIG. 2 position to begin closing-off communication of lubricating oil from conduit 23 to conduit 36 for piston cooling purposes. In particular, piston cooling is normally not required at a low idle condition of engine operation. The fully opened or fully closed condition of valve operation may be suitably adjusted to any convenient range by proper selection of a suitable spring rate and preload for coil spring 30.

What is claimed is:

1. A method for communicating lubricant to the crankshaft and rod bearings of an engine, to the bearing of a turbocharger mounted on the engine and to the cooling jets associated with pistons reciprocally mounted in the engine comprising the steps of first communicating lubricant only to each of said crankshaft and rod bearings and the bearings of said turbocharger upon start-up of said engine and second communicating lubricant to each of said crankshaft and rod bearings, the bearings of said turbocharger and to said cooling jets after start-up of said engine and when the pressure of said lubricant exceeds a predetermined level.

2. The method of claim 1 wherein said first step comprises communicating filtered lubricant to said crankshaft and rod bearings and communicating unfiltered lubricant to the bearings of said turbocharger.

3. The method of claim 2 wherein said second step comprises communicating filtered oil to each of said crankshaft and rod bearings and to the bearings of said turbocharger.

4. The method of claim 3 wherein said second step further comprises communicating unfiltered oil to said cooling jets.

5. The method of claim 1 further comprising the step of cooling said lubricant prior to its communication during said first and second steps.

6. The method of claim 1 wherein said first and second steps comprise automatically shifting a spool of a directional control valve.

* * * * *